US006789287B2

(12) United States Patent
Calabrese

(10) Patent No.: US 6,789,287 B2
(45) Date of Patent: Sep. 14, 2004

(54) PORTABLE BILLIARD BALL POLISHING DEVICE

(76) Inventor: Peter Calabrese, 180 Totem Dr., Auburn, PA (US) 17922

( * ) Notice: Subject to any disclaimer, the term of this patent is extended or adjusted under 35 U.S.C. 154(b) by 0 days.

(21) Appl. No.: 10/329,942

(22) Filed: Dec. 27, 2002

(65) Prior Publication Data

US 2003/0121115 A1 Jul. 3, 2003

Related U.S. Application Data

(60) Provisional application No. 60/344,274, filed on Jan. 3, 2002.

(51) Int. Cl.[7] ..... A63B 47/04
(52) U.S. Cl. ..... 15/97.1; 15/21.2; 15/21.1
(58) Field of Search ..... 15/21.1, 21.2, 15/97.1

(56) References Cited

U.S. PATENT DOCUMENTS

| | | | | | |
|---|---|---|---|---|---|
| 1,991,183 | A | * | 2/1935 | Sundahl | 15/21.2 |
| 3,041,645 | A | * | 7/1962 | Smith | 15/97.3 |
| 3,654,655 | A | * | 4/1972 | Mitnick | 15/21.2 |
| 5,758,379 | A | * | 6/1998 | Hovnanian | 15/97.1 |

* cited by examiner

*Primary Examiner*—Gary K. Graham
(74) *Attorney, Agent, or Firm*—A. R. Eglington

(57) ABSTRACT

A portable billiard ball polishing device configured for use with a buffing pad comprising a generally hollow body having a closed bottom surface, arcuate sidewalls and an open upper surface. The hollow body sidewalls are segmented to provide lower and upper cavities of varying diameter, to receive a first resilient pad in the lower cavity, and a second resilient pad in the upper cavity of the device, and a sleeve-shaped inner liner configured to the sidewalls of the hollow body.

10 Claims, 3 Drawing Sheets

PORTABLE BILLIARD BALL POLISHING DEVICE

CROSS REFERENCE TO OTHER APPLICATIONS

This application claims the benefit of U.S. Provisional Application No. 60/344,274, filed Jan. 3, 2002.

SUMMARY OF THE INVENTION

According to the present invention, there is provided a billiard ball cleaning and polishing assembly comprising: (a) a formed hollow member having a generally circular open upper end and a closed lower end adapted to seat on a planar support surface; (b) a resilient disk, configured and sized to nest snugly into the hollow of the base member; (c) an upper formed hollow member having both open upper and lower ends and having its lower peripheral segment of a reduced size adapted to seat tightly within the inner periphery of the first member underlying it; a second disk-like buffing pad, preferably of a terry cloth outer composition, configured and sized to nest snugly within the upper member, and of a thickness such that when placed in situ, such pad presents a substantial free margin for the uppermost peripheral sidewall segment of the upper wall member; a second disk adapted to operate as a roll-like buffer cloth on its one external surface and being provided with a centrally positioned fixed shaft on its reverse surface, and with the second disk shaft being adapted to engage the rotational chuck portion of a power drill device.

DETAILED DESCRIPTION OF THE DRAWINGS

Figure 1:
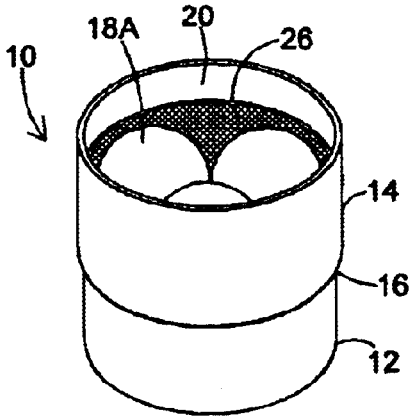
FIG. 1 is a perspective view of the ball receptacle component ready to receive a superimposed powered buffing device of the present invention.

Referring to the drawing, and to FIG. 1 in particular, the cylindrical receptacle, generally 10, comprises a lower base member 12, adapted for seating on a planar support surface (not seen) and an upper member 14, also generally cylindrical form, and seated on the peripheral rim 16 of the lower member 12. Three balls, 18A/C, are deposited within upper member 14, which has arcuate sidewalls of a height sufficient to provide a substantial free margin 20, for purposes to be described. The depicted embodiment is sized to run three balls, but larger diameter embodiments can be fabricated, to polish four or seven balls simultaneously.

Figure 3:
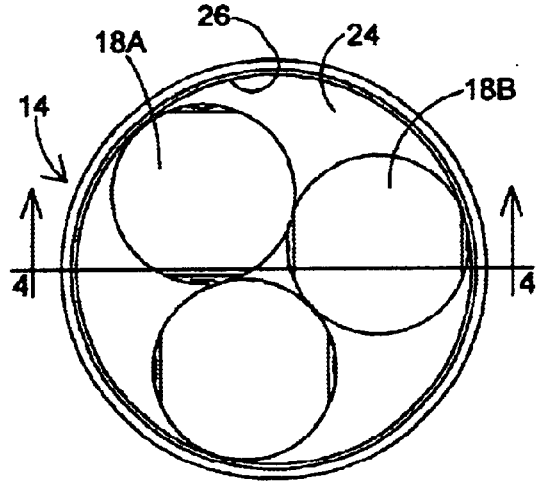
FIG. 3 is a top plan view of the ball receptacle, loaded with three billiard balls, and adapted to receive the balls buffing device overhead.
Figure 2:
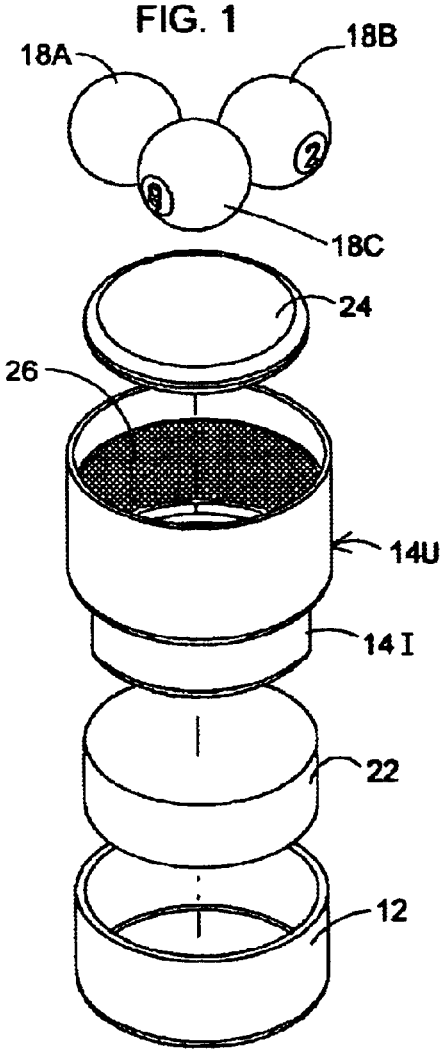
FIG. 2 is an isometric exploded view of the five elements of the ball receptacle comprising itself, and the overlying triad of billiard balls.

In the exploded view of FIG. 2, the several operative components of the ball holding bushing receptacle are depicted: lower member 12; resilient inner pad 22, upper hollow and segmented member 14, disk-like, and resilient upper pad 24, and felt-like peripheral liner 26, which provides frictional resistance to halt induced rotation of pad 24. Upper member 14 has a reduced diameter sidewall located proximal the lower longitudinal end thereof (FIG. 3). This provides an annular shoulder 27, which seats on the peripheral rim 16 of lower member 12. Upper pad 24 has a formed core interior 24F (FIG. 3) (such of as a foamed polyurethane) and an external cover 28 of a terry cloth, textile nature. Pad 24 abuts the underlying resilient pad 22, such that the contacting surfaces have sufficient frictional interplay, whereby upper pad 24 effectively resists the rotational force being imposed thereon by the rotating billiard balls during powered polishing. An inner peripheral, sleeve-like liner 26, of a Velcro-Like surface consistency, also aids in the pad 24 inhibiting function. Liner 26 can be produced from a net-like, woven polyolefin. As noted, the upper component 14U of ball receptacle 10 has a larger diameter segment and the lower part a lesser diameter segment 14L, which provide the annular shoulder 26, which is sized to closed with inner lower surface. In this manner, the upper component abuts and seats tightly against the circular rim of the base component. It is preferably bonded thereto.

Also, in the top plan view of FIG. 3, a ball set 18A/C, is nested upon the underlying terry cloth, pad 24 and is ready for processing.

Figure 4:
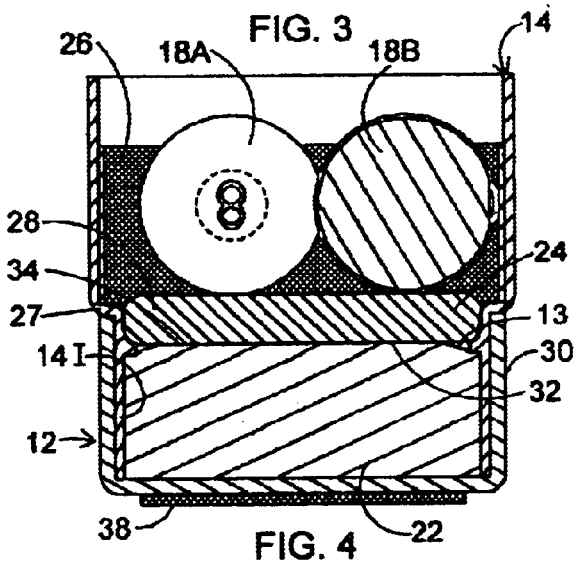
FIG. 4 is a vertical sectional view of the device, taken along lines 4—4 of FIG. 3, revealing the juxtaposition of the ball-loaded receptacle elements as oriented for the buffing action.

The vertical sectional view of FIG. 4, shows upper member 14, nested on lower member 12 on sidewall 30 via shoulder 27 on peripheral rim 16. Resilient inner pad 22 is essentially enclosed within lower member 12, except for the exposed upper surface 32 thereof, which surface interfaces with the exposed lower surface 34 of upper pad 24 which rests on annular ledge 13. Rubberized base pad 38 acts to stabilize receptacle 10.

In operation, the abutting pads make abrasive contact under a mechanical bushing force, and pad 24 is largely arrested from substantial movement within the upper member 14.

Figure 5:
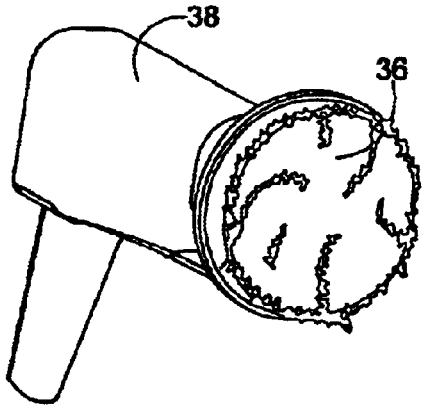
FIG. 5 is an elevational perspective view of buffing surface of the motor-mounted pad.

In the front elevational view of FIG. 5, the circular planar surface of motor driven, buffing pad 36 is depicted, being sized circumferentially to seat snugly within the upper receptacle 14 sidewalls, and so to vigorously contact and rotate the contained balls.

Figure 6:
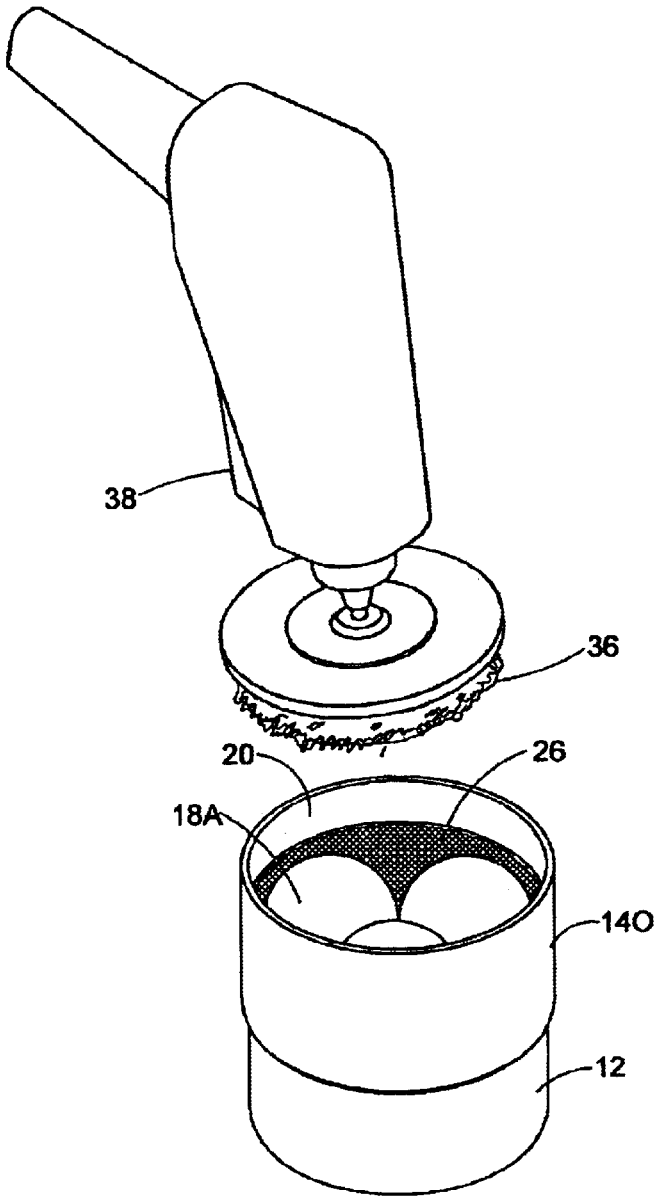
FIG. 6 is a perspective view of the loaded receptacle set for engagement of the motor-driven disk-like buffing pad with the loaded receptacle underneath.

In the perspective view of FIG. 6, both receptacle 14 and motor mounted, buffer pad 36 are now aligned spatially to initiate the cleaning/polishing operation using hand-held, standard drill-type motor 38.

Figure 7:
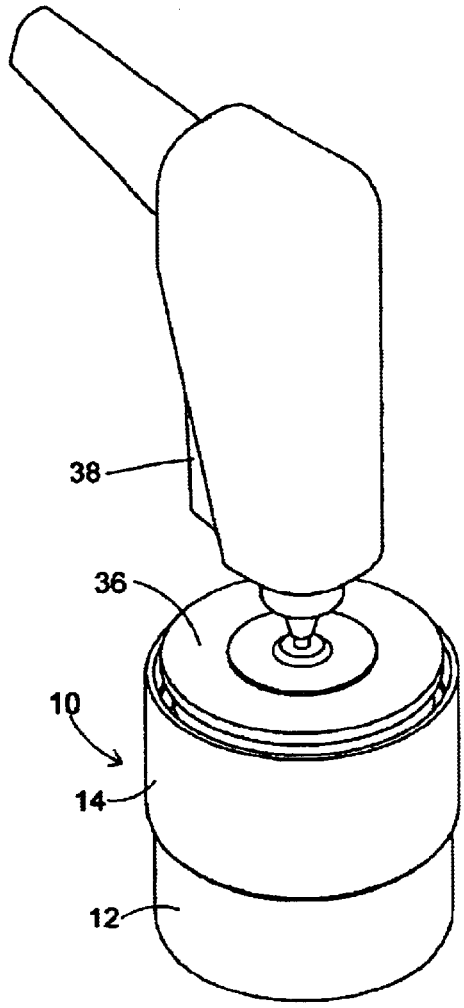
FIG. 7 is perspective view depicting the powered rotating buffer pad engaged with the balls-loaded receptacle.

The perspective view of FIG. 7 depicts the buffer pad 36 is in its operative rotational engagement with the deposited balls (FIG. 6), thereby effecting the intended ball washing function.

Resilient cylindrical pad 22 is composed of a polymeric material, such as a formable polyurethane, is cut in size to seat within base component 12. Upper pad 24 serves to assist in the balance, or counter balance, of the unit occurring during the rapid rotational motion imposed on the deposited billiard balls by the motor-shaft mounted wheel-like buffing disk 36. Seated over resilient pad 22 is the circular pad 24, having a terry cloth wrapped, formable center which is exposed within the upper cavity defined by the sidewalls of the upper component 14. Upper cloth pad 24 is sized so as to permit a free vertical margin on the receptacle sidewall of at least two inches. The depth of such margin is chosen sufficient to receive fully the axial width of the wool buffing disk when within the sidewalls, thus confining the buffing disk to controlled rotational contact with the deposited billiard balls.

The buffing unit may be of at least three diverse cavity inner diameters in order to process three, four, or seven billiard balls (5, 6, or 7 inches, respectively). The presently preferred embodiment is an upper component 14 having a five inch diameter, and adapted for accepting three balls for concurrent cleaning/buffing.

Figure 9:
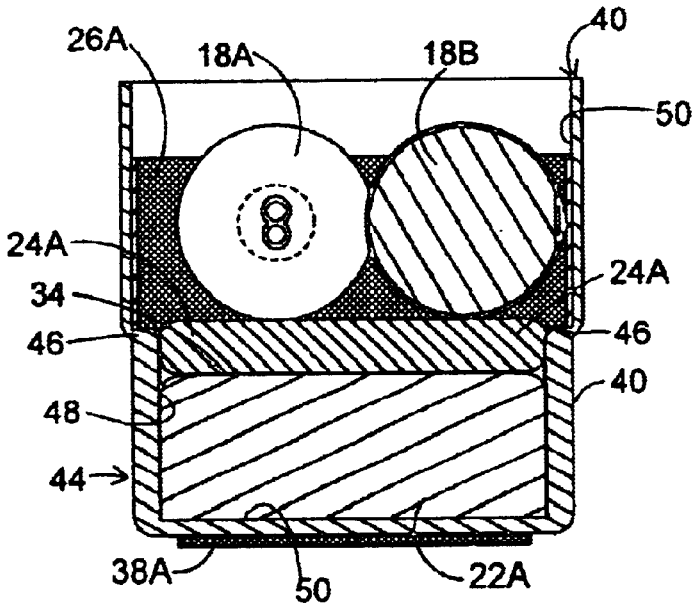

For a 3-ball (14/40) buffing receptacle of either FIG. 4 or 9, suitable dimensions are: lower segment 2.25" height, an inner diameter of 4.25" with a sidewall thickness of 0.375". For the lower segment: 2.25" in height, with sidewall thickness of 0.375". For the upper segment, 3.25" in height, inner diameter of 5.035", and wall thickness of 0.15". The peripheral ledge 46 is of about 0.39" in width, and has the two pads sized accordingly to snugly seat in their receptacle cavities, 48 and 50, respectively.

For the four and five ball receptacles, the vertical dimensions remain substantially the same, while the internal diameter is modified to the 6 and 7 inch diameters, indicated above. For the four ball six inch diameter receptacle, an optional cylindrical post is affixed centrally of the lower surface of the receptacle to facilitate.

Both the upper component 14, and the base component 12 may be fabricated from a commercially available rigid plastic tubing segments, which can be transversely severed to provide the desired depths. Molded polyvinyl chloride tubing (PVC) #1120, of established drain line utility, and also meeting ASTM2-2729, has specifications that can be usefully adapted here for receptacle fabrication. PVC material is suitable because of its durability, ready molding features in a variety of circular diameters, and severable lengths, which serve to provide a cost effective, final assembly. Extruded aluminum is an alternative material of fabrication, but is more costly, and is liable to denting and warping if mishandled during the many cycles of use to respected with this device. Other materials of fabrication will be evident to those skilled in the receptacle canister fabrication arts.

Liner 26 is made of nylon filament, Velcro weave preferred, and is used because of its buffing qualities. As to the billiard balls, on spinning pads 24 and 36, they buff, as well as by the peripheral liner 26.

Figure 8:
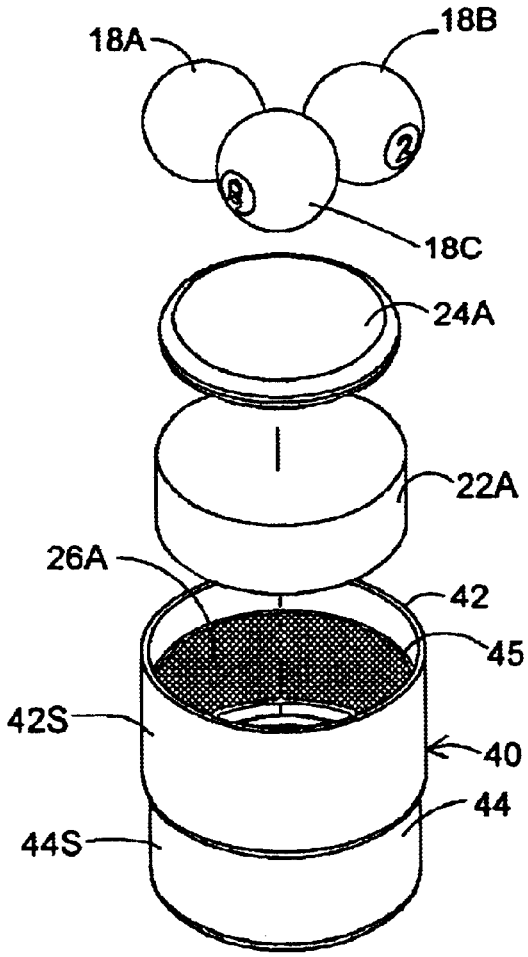
FIG. 8 is another isometric exploded view of the four elements of the presently preferred embodiment, with an overlying triad of billiard balls; and, FIG. 9 is a vertical sectional view of the device of FIG. 7, with a the components conjoined, like that of the top plan view of FIGS. 3 and 4.

In the exploded view of FIG. 8, a presently preferred embodiment of the invention is depicted, comparable to the similar view of the earlier embodiment seen in FIG. 2. In this embodiment, a lower and upper members, 12 and 14, have been integrated into a two-tiered, single member 40, for economy of fabrication. The operative components are now: segmented receptacle 40, resilient inner pad 22A, disk-like resilient upper pad 24A, and web-like, peripheral liner 26A. Upper segment 42 of receptacle 40 has a somewhat enlarged diameter 45, relative to that of the lower segment 44, with each being sized to present a horizontal annular ledge 46, which is located intermediate the longitudinal ends of receptacle sidewalls.

Inner pad 22A seats snugly in lower cavity 48, while outer pad 24A overlies and seats peripherally upon ledge 46 at the base of upper cavity 50. Upstanding liner 26A is substantially identical to that of the first embodiment and with a similar function. Balls set 18 are deposited upon buffing pad 24A and are encompassed by liner upstanding 26A.

The integral receptacle 40 is fabricated as follows. The material constructions are from commercially available polymeric materials, which form rigid structures, such as of PVC plastic and/or ABS copolymeric materials.

What is claimed is:

1. A portable billiard ball polishing device comprising:

(a) a generally hollow body having a closed bottom surface, upstanding arcuate sidewalls and an open upper surface, thereby defining a cavity adapted for receipt and retention of ball support elements and adapted for the selective deposit of a plurality billiard balls to be cleaned and polished therein;

(b) the hollow body comprising of a lower first circular sidewall segment of a first diameter and a conjoined upper second sidewall segment of a somewhat larger second diameter, with the first lower segment, thereby providing an internal surface, annular ledge located proximal to the jointure of the abutting first and second sidewall segments;

(c) a first resilient pad of a first thickness with said pad having the first diameter sized to be snugly fitted into a lower first compartment as defined by the lower first segment;

(d) a second resilient pad of a lesser second thickness than that of the first pad, and sized to be fitted into the body and to contact and rest functionally upon the underlying second pad;

(e) a sleeve shaped, flexible liner configured to contact the inner sidewalls of the upper second segment and adapted to provide added frictional resistance to any rotating ball deposited within the upper segment of the hollow body receptacle; and, (f) a generally planar, buffing pad configured and sized to functionally penetrate the upper segment and to compressingly engage deposited billiard balls so as to rotate same during the polishing step.

2. The polishing device of claim 1 wherein the buffing pad is mounted axially on a rotating shaft which is adapted to provide power buffing force on billiard balls deposited within the device.

3. The device of claim 1 wherein an elastomeric support pad is bonded to the closed bottom outer surface of the hollow body to resist the torsional force imposed on the device during the billiard ball buffing step.

4. The device of claim 1 wherein the lower first resilient pad is fabricated from formable polyurethane.

5. The device of claim 1 wherein the overlying second resilient pad is fabricated from a terry cloth wrapped formable center.

6. The device of claim 1 wherein the annular inner liner of the upper segment is fabricated from woven polyolefin.

7. A portable billiard ball polishing device configured for use with a powered buffing pad comprising:

(a) a dual component, hollow body having an open upper surface and a closed bottom surface of a first diameter further comprising:

(i) a generally lower first circular sidewall component of a first diameter having an open upper surface, upstanding uniform sidewall, and a closed bottom surface;

(ii) a generally cylindrical, upper component having a first upper segment of a second diameter substantially identical to the first diameter of the lower first component, and having a second lower segment of a third lesser diameter sized to permit sliding engagement of said second lower segment within the sidewalls of the lower component; and internally projecting annular ledge provided on the inner sidewalls of the lower segment proximal to the seam of the first and second conjoined segments, (iii) a first resilient fabric covered pad of a first thickness sized to be snugly fitted into the cavity defined by the first component;

(iv) a second resilient fabric covered pad of a second and lesser thickness than the first pad and sized to be fitted into and to seat upon the annular ledge of the lower component; and, (v) a sleeve-shaped, flexible liner configured to reside against the inner sidewalls of the upper segment and adapted to provide added frictional resistance to ball rotation.

8. The device of claim 7 wherein the lower first resilient pad is fabricated from formable polyurethane.

9. The device of claim 7 wherein the overlying second resilient pad is fabricated from a terry cloth wrapped formable center.

10. The device of claim 7 wherein the annular inner liner of the upper segment is fabricated from woven polyolefin.

* * * * *